US011105035B2

(12) United States Patent
Lee et al.

(10) Patent No.: US 11,105,035 B2
(45) Date of Patent: Aug. 31, 2021

(54) WASHING MACHINE

(71) Applicant: LG Electronics Inc., Seoul (KR)

(72) Inventors: Kilryong Lee, Seoul (KR); Dongwon Kang, Seoul (KR); Yeongkyeong Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 37 days.

(21) Appl. No.: 16/779,242

(22) Filed: Jan. 31, 2020

(65) Prior Publication Data

US 2020/0283946 A1 Sep. 10, 2020

(30) Foreign Application Priority Data

Feb. 1, 2019 (KR) ..... 10-2019-0013997

(51) Int. Cl.
*D06F 39/08* (2006.01)
*D06F 37/26* (2006.01)

(52) U.S. Cl.
CPC ..... *D06F 39/085* (2013.01); *D06F 37/266* (2013.01); *D06F 39/088* (2013.01)

(58) Field of Classification Search
CPC ..... D06F 39/085
See application file for complete search history.

(56) References Cited

U.S. PATENT DOCUMENTS

2016/0053422 A1* 2/2016 Im ..... D06F 39/085 8/137

FOREIGN PATENT DOCUMENTS

| | | |
|---|---|---|
| EP | 2589697 | 5/2013 |
| EP | 2719814 | 4/2014 |
| JP | 2012070810 | 4/2012 |
| KR | 1020180131894 | 12/2018 |

OTHER PUBLICATIONS

Extended European Search Report in European Application No. 20154872.4, dated Jun. 2, 2020, 9 pages.

* cited by examiner

*Primary Examiner* — Jason Y Ko
(74) *Attorney, Agent, or Firm* — Fish & Richardson P.C.

(57) ABSTRACT

A present disclosure provides a washing machine including first and second nozzles which are provided on an inner peripheral surface of a gasket, first and second balancers disposed on the front surface of the tub and outside the gasket, and a circulating water supply pipe which guides the water pumped by a pump to the first and second nozzles. The circulating water supply pipe includes first and second discharge ports protruding toward the gasket and respectively inserted into a first connector and a second connector. The first and second balancers are disposed to be spaced by a distance shorter than lengths of the first and second discharge ports from outer surfaces of the first and second discharge portions facing the first and second balancers. Accordingly, it is possible to prevent the circulating water supply pipe from being removed.

20 Claims, 10 Drawing Sheets

WASHING MACHINE

CROSS-REFERENCE TO RELATED APPLICATION

This application claims the benefit of priority to Korean Application No. 10-2019-0013997, filed on Feb. 1, 2019. The disclosure of the prior application is incorporated by reference in its entirety.

BACKGROUND OF THE INVENTION

Field of the Invention

The present disclosure relates to a washing machine, and more particularly, to a washing machine having a nozzle for injecting water which is discharged from a tub and circulates along a circulation pipe into a drum.

Related Art

In general, a washing machine is a general term for a device which separates contaminants from clothing, bedding, or the like (hereinafter, referred to as "cloth") by using chemical electrolysis of water and detergent and a physical action such as a friction between water and laundry.

The washing machine includes a tub in which water is stored and a drum which is rotatably provided in the tub and accommodates laundry. Recently, in a washing machine, water discharged from the tub is circulated using a circulation pump, and the circulating water is injected into the drum through a nozzle. In this case, a circulating water supply pipe is connected to the circulation pump, water pressure-fed by the circulation pump is guided along the circulating water supply pipe, the guided water is supplied to the nozzle again through a connector which connecting the nozzle and the circulating water supply pipe to each other.

In a washing machine (Korean Patent Laid-Open Publication No. 10-2018-0131894) of the related art, in order to prevent a circulating water supply pipe from being removing from a gasket when circulating water is supplied from the circulating water supply pipe, a nozzle water supply port of the circulating water supply pipe is inserted into a port insertion pipe of the gasket, and thereafter, is fastened by a clamp.

However, a cumbersome step of fastening the clamp in a narrow space when the circulating water supply pipe and the gasket are assembled to each other is added, and this step cannot be performed by a machine. Accordingly, there is a problem that a time and cost required to perform the assembly increase.

Moreover, the circulating water supply pipe is required to be separated by at least a width of the clamp from the gasket in order to fasten the clamp, and a protrusion is provided in the circulating water supply pipe in order to perform the separation. Accordingly, there are problems that a balancer disposed in an upper side and a balancer disposed in a lower side are vertically separated from each other in order to prevent an interference between the protrusion and a balancer, and the protrusion should be disposed between the balancers disposed on the upper side and the lower side.

SUMMARY OF THE INVENTION

The present disclosure provides a washing machine capable of preventing a circulating water supply pipe from being removed from a gasket.

The present disclosure also provides a washing machine capable of preventing the removal of the circulating water supply pipe without fastening the circulating water supply pipe and the gasket by a clamp.

The present disclosure also provides a washing machine capable of assembling or disassembling the gasket and the tub without separating a large and heavy balancer from the tub while preventing the circulating water supply pipe from being removed from the gasket using the balancer.

Objects of the present disclosure are not limited to the objects mentioned above, and other objects not mentioned will be clearly understood by a person skilled in the art from the following description.

In an aspect, the present disclosure provides a washing machine which includes a circulating water supply pipe which guides water pressure-fed by a pump to the first and second nozzles injecting the water into a drum.

The circulating water supply pipe includes an inlet port to which water discharged from the pump flows. The circulating water supply pipe includes a feeding conduit which guides the introduced water introduced to the first and second nozzles.

The feeding conduit is disposed between first and second balancers disposed on both right and left sides of a front surface of a tub and a gasket. The feeding conduit includes first and second discharge portions corresponding to positions corresponding to first and second connectors having holes communicating with the first and second nozzles.

The circulating water supply pipe includes first and second discharge ports which protrude toward a center of the gasket from the first and second discharge portions. The first and second discharge ports are respectively inserted into the first and second connectors. Outer surfaces of the first and second discharge portions face the first and second balancers.

The first and second balancers are disposed to be spaced by a distance shorter than lengths of the first and second discharge ports from the outer surfaces of the first and second discharge portions.

The first connector and the second connector may protrude from an outer peripheral surface corresponding to a side opposite to the inner peripheral surface of the gasket.

The first and second discharge port may be formed to be at least two times a distance between the outer surfaces of the first and second discharge portions and the first and second balancers.

The feeding conduit may be formed to be convex in a direction in which the first and second discharge portions are away from an outer peripheral surface corresponding to a side opposite to the inner peripheral surface of the gasket.

Each of the first and second balancers may include an arc-shaped inner peripheral surface facing the outer peripheral surface of the gasket.

Each of the inner peripheral surfaces of the first and second balancers may include a support portion which is formed to be concave in the direction away from the outer peripheral surface of the gasket at a position corresponding to the discharge portion of the circulating water supply pipe.

The tub may include an inlet periphery which forms the opening, protrudes from a front surface, and is curled outward, the gasket may include a tub coupling portion coupled to the inlet periphery of the tub, the washing machine may include a clamp which is located at the tub coupling portion and is formed of a wire, and the tub and the gasket may be fixed to each other by the clamp.

The feeding conduit may include a conduit portion which connects the first and second discharge portions to each other, and a distance between the conduit portion and the first and second balancers may be larger than a diameter of the clamp.

A distance between each of the outer surfaces of the first and second discharge portions and each of the first and second balancers may be smaller than or equal to a diameter of the clamp.

Each of the first and second nozzles may include first and second lower nozzles disposed below a center of the gasket and first and second upper nozzles disposed above the first and second lower nozzles.

The first connector may include a first lower connector having a hole communicating with the first lower nozzle and a first upper connector having a hole communicating with the first upper nozzle, and the second connector may include a second lower connector having a hole communicating with the second lower nozzle and a second upper connector having a hole communicating with the second upper nozzle.

The first discharge port may include a first lower discharge port inserted into the first lower connector and a first upper discharge port inserted into the first upper connector, and the second discharge port may include a second lower discharge port inserted into the second lower connector and a second upper discharge port inserted into the second upper connector.

Details of other embodiments are included in a detail description and the drawings.

DESCRIPTION OF EXEMPLARY EMBODIMENTS

Figure 1:
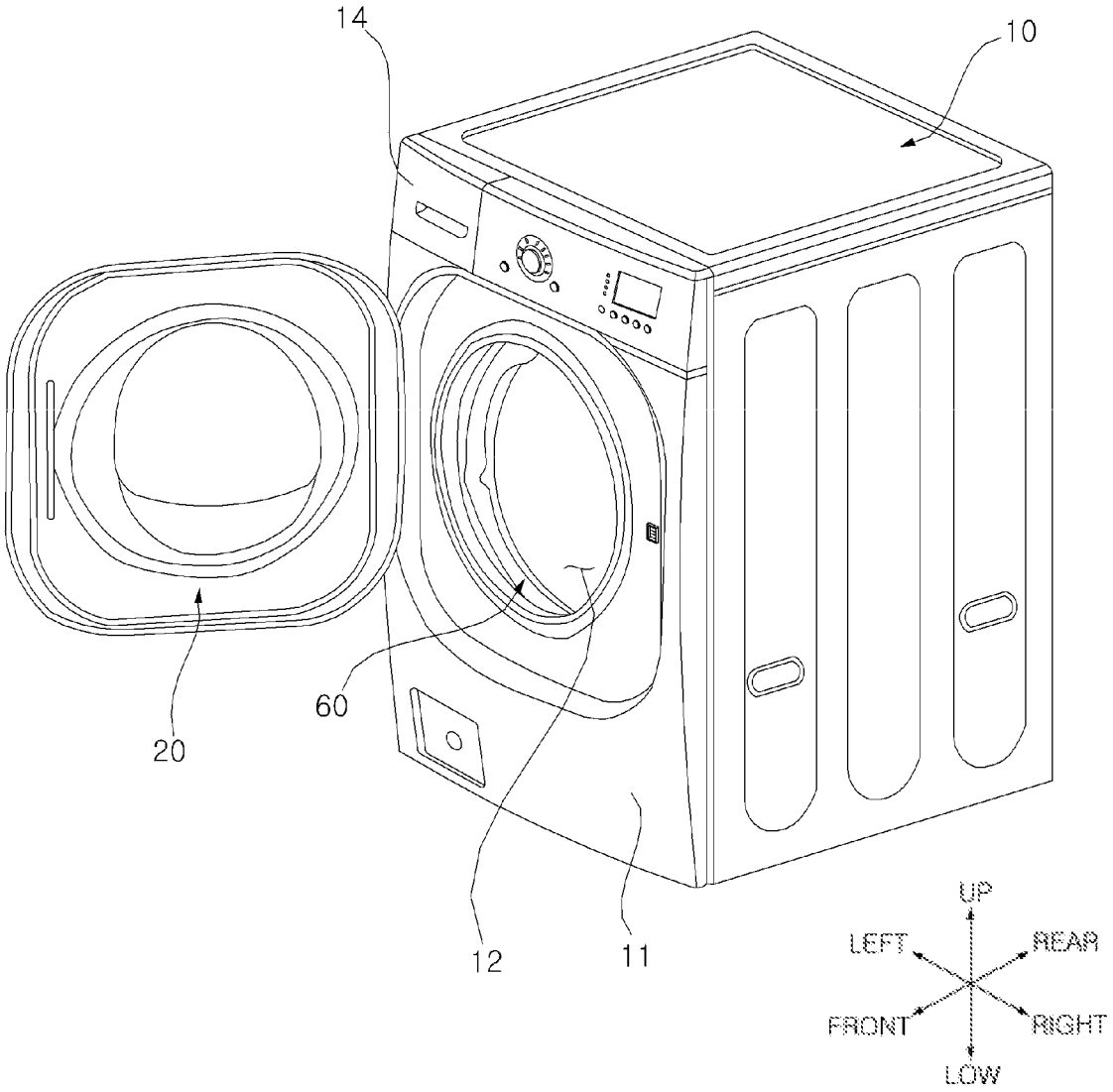
FIG. 1 is a perspective view illustrating a washing machine according to an embodiment of the present disclosure.

Advantages and features of the present disclosure and methods of achieving them will be apparent with reference to embodiments described below in detail in conjunction with the accompanying drawings. However, the present disclosure is not limited to the embodiments disclosed below, but may be implemented in various forms. The present embodiments are merely provided to complete the disclosure of the present disclosure and to fully inform a person skilled in the art of the present disclosure of the scope of the present disclosure, and the present disclosure is defined by the scope of claims. The same reference numerals refer to the same elements throughout.

Hereinafter, the present disclosure will be described with reference to the drawings in order to describe a washing machine according to embodiments of present disclosure.

Figure 2:
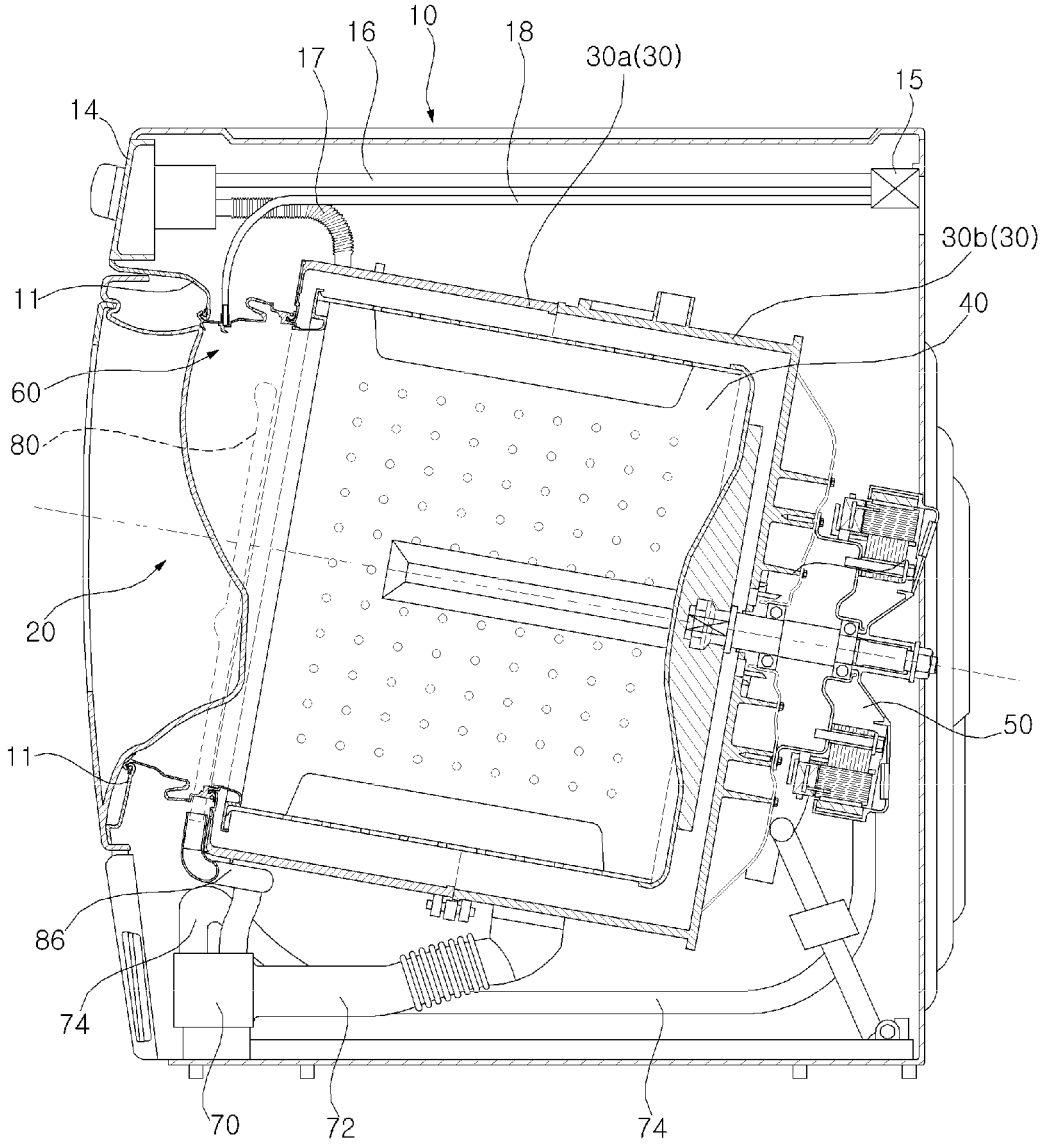
FIG. 2 is a cross-sectional view of the washing machine illustrated in FIG. 1.

Referring to FIGS. 1 and 2, a washing machine according to an embodiment of present disclosure includes a casing 10 for forming an exterior, a tub 30 for storing wash water, and a drum 40 which is rotatably provided in the tub 30 and into which laundry is introduced. In addition, the washing machine may include a motor 50 (hereinafter, may be referred to as "drive unit") for rotating the drum.

A front panel 11 having a laundry inlet 12 is disposed on a front surface of the casing 10, a door 20 for opening or closing the laundry inlet 12 is disposed in the front panel 11, and a dispenser 14 into which a detergent is input may be provided in the front panel 11.

Moreover, a water supply valve 15, a water supply pipe 16, and a water supply hose 17 are installed inside the casing 10, washing water which has passed through the water supply valve 15 and the water supply pipe 16 is mixed with the detergent in the dispenser 14 when water is supplied, and thereafter, may be supplied to a tub 30 through the water supply hose 17.

Meanwhile, a direct water supply pipe 18 is connected to the water supply valve 15, and thus, the washing water is not mixed to the detergent and is directly supplied into the tub 30 through the direct water supply pipe 18.

Moreover, a pump 70 and a circulating water supply pipe 80 is installed, the pump 70 and the tub 30 are connected to each other by a discharge hose 72, and the circulating water supply pipe 80 and the pump 70 may be directly connected to each other or may be connected to each other by a connection pipe 86. Accordingly, when the pump 70 is operated, the washing water stored in the tub 30 may be injected into the drum 40 through the circulating water supply pipe 80 to be circulated. The pump 70 is connected to a drain pipe 74, and thus, the washing water may be discharged to the outside through the drain pipe 74.

As described above, the pump 70 according to the embodiment of the present disclosure functions as a drain pump for discharging the washing water to the outside and a circulation pump for circulating the washing water. However, unlike to this, the drain pump and the circulation pump may be separately provided, and when the drain pump and the circulation pump are separately provided, it is natural that the drain pipe 74 is connected to the drain pump and the connection pipe 86 is connected to the circulation pump.

Meanwhile, the tub 30 may be formed as a single tub body or first and second tub bodies 30*a* and 30*b* may be formed to be fastened to each other. In the present embodiment, a case where the first and second tub bodies 30*a* and 30*b* are fastened to each other to from the tub 30 is described as an example. Hereinafter, the first tub body 30*a* is simply referred to as the "tub 30".

The tub 30 is disposed inside the casing 10 and an opening (32, refer to FIG. 4) corresponding to the laundry inlet 12 formed on the front panel 11 is formed at a front portion of the tub 30.

The drum 40 in which the laundry is accommodated is rotatably provided in the tub 30. The drum 40 accommodates the laundry, includes an inlet through which the laundry is input and which is disposed on a front surface thereof, and rotates about a rotation center line which is substantially horizontal. However, the term "horizontal" is not a term used in a mathematically exact sense. That is, as in the embodiment, when the rotation center line is inclined at a predetermined angle with respect to the horizontal, it may also be said to be substantially horizontal because it is closer to the horizontal than the vertical. A plurality of through holes may be formed such that the water in the tub 30 flows into the drum 40 through the through holes.

A plurality of lifters may be provided on an inner surface of the drum 40. The plurality of lifters may be disposed to have a predetermined angle with respect to a center of the drum 40. When the drum 40 rotates, the laundry is repeatedly lifted and dropped by the lifters.

The drive unit 50 for rotating the drum 40 may be further provided, and a drive shaft rotated by the drive unit 50 may pass through a rear surface of the tub 30 and may be coupled to the drum 40.

Preferably, the drive unit 50 may be configured to include a direct type washing motor, and the washing motor may include a stator which is fixed to a rear side of the tub 30 and a rotor which is rotated by a magnetic force acting between the stator and the rotor. The drive shaft may be integrally rotated with the rotor.

Figure 3:
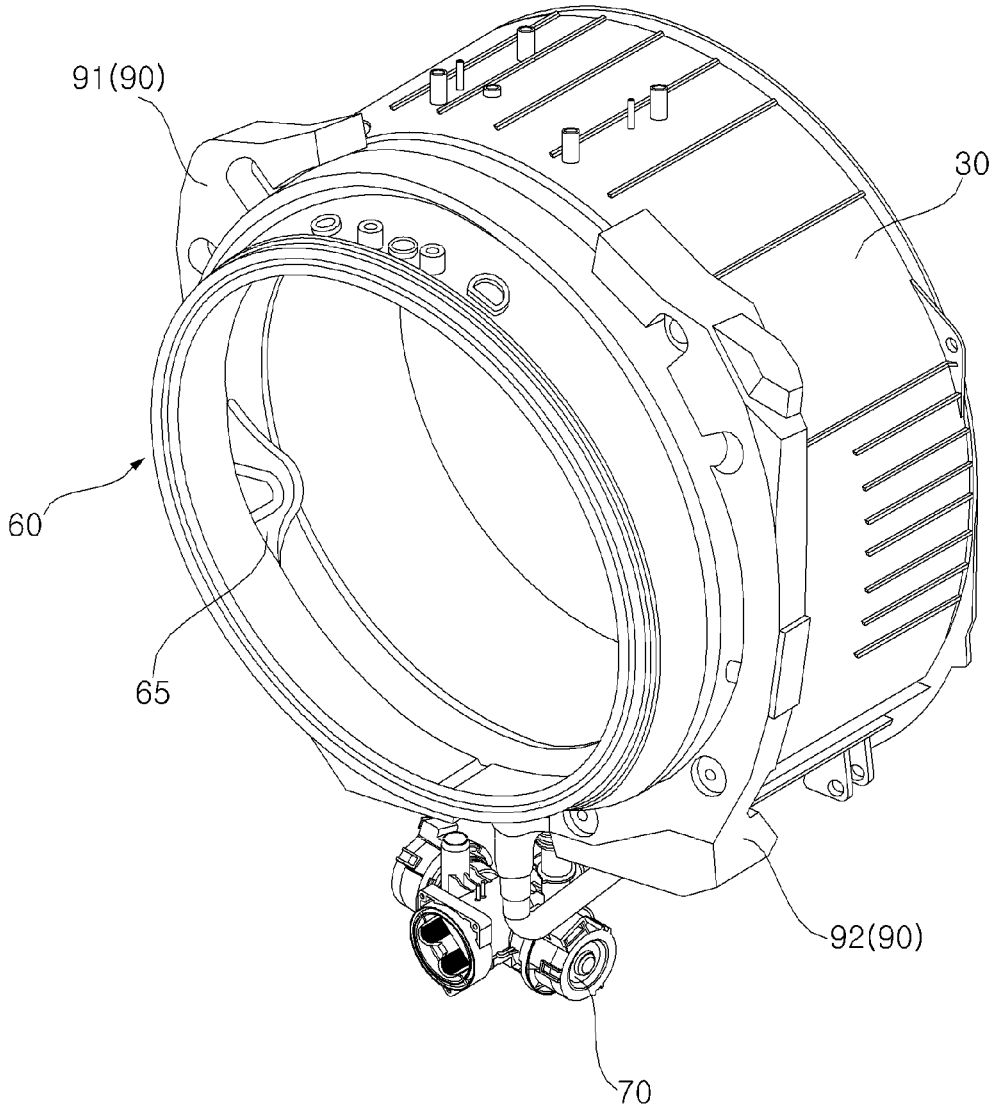
FIG. 3 is a view illustrating a portion of the washing machine according to the embodiment of the present disclosure.
Figure 4:
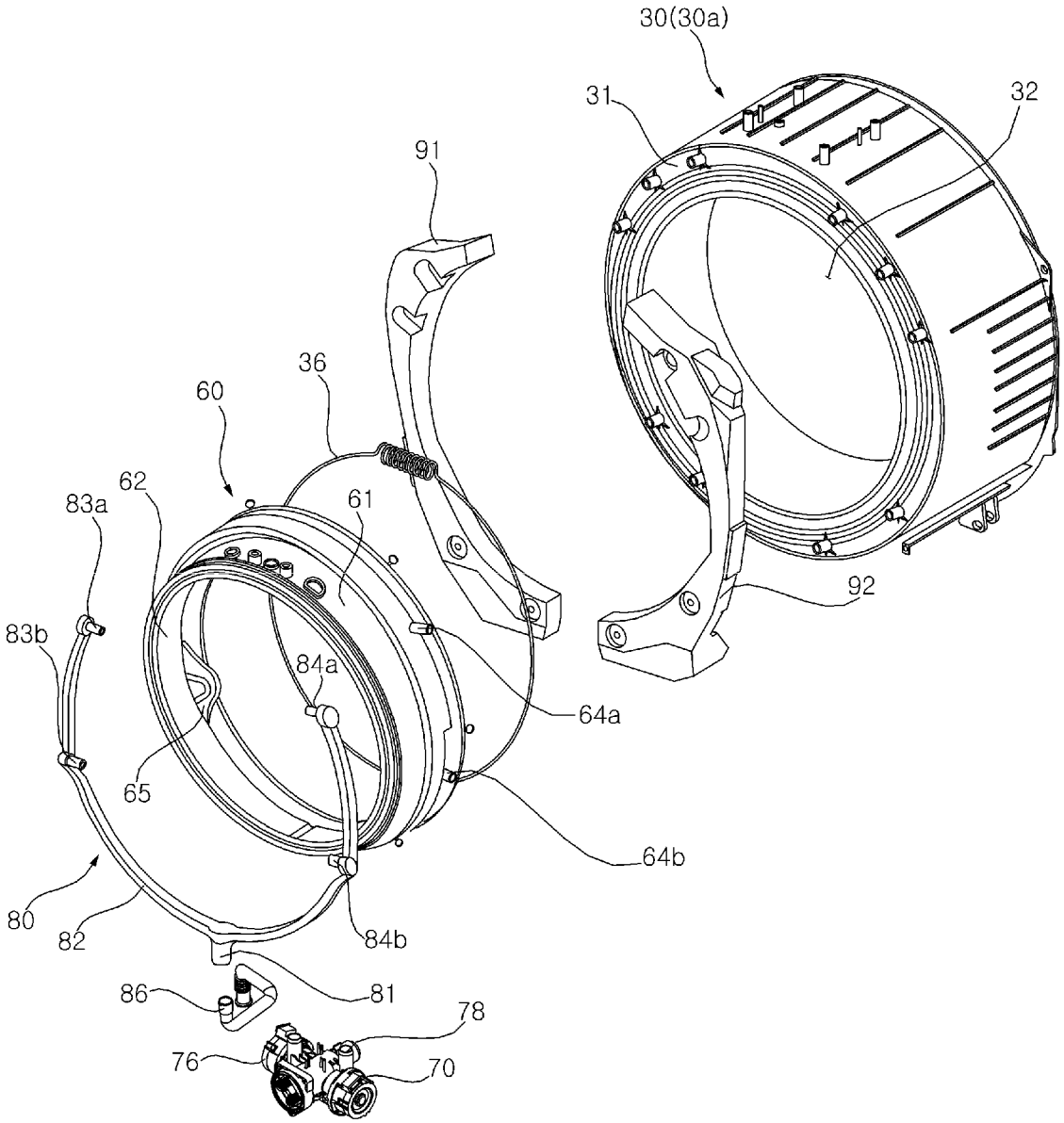
FIG. 4 is an exploded perspective view of an assembly illustrated in FIG. 3.
Figure 6:
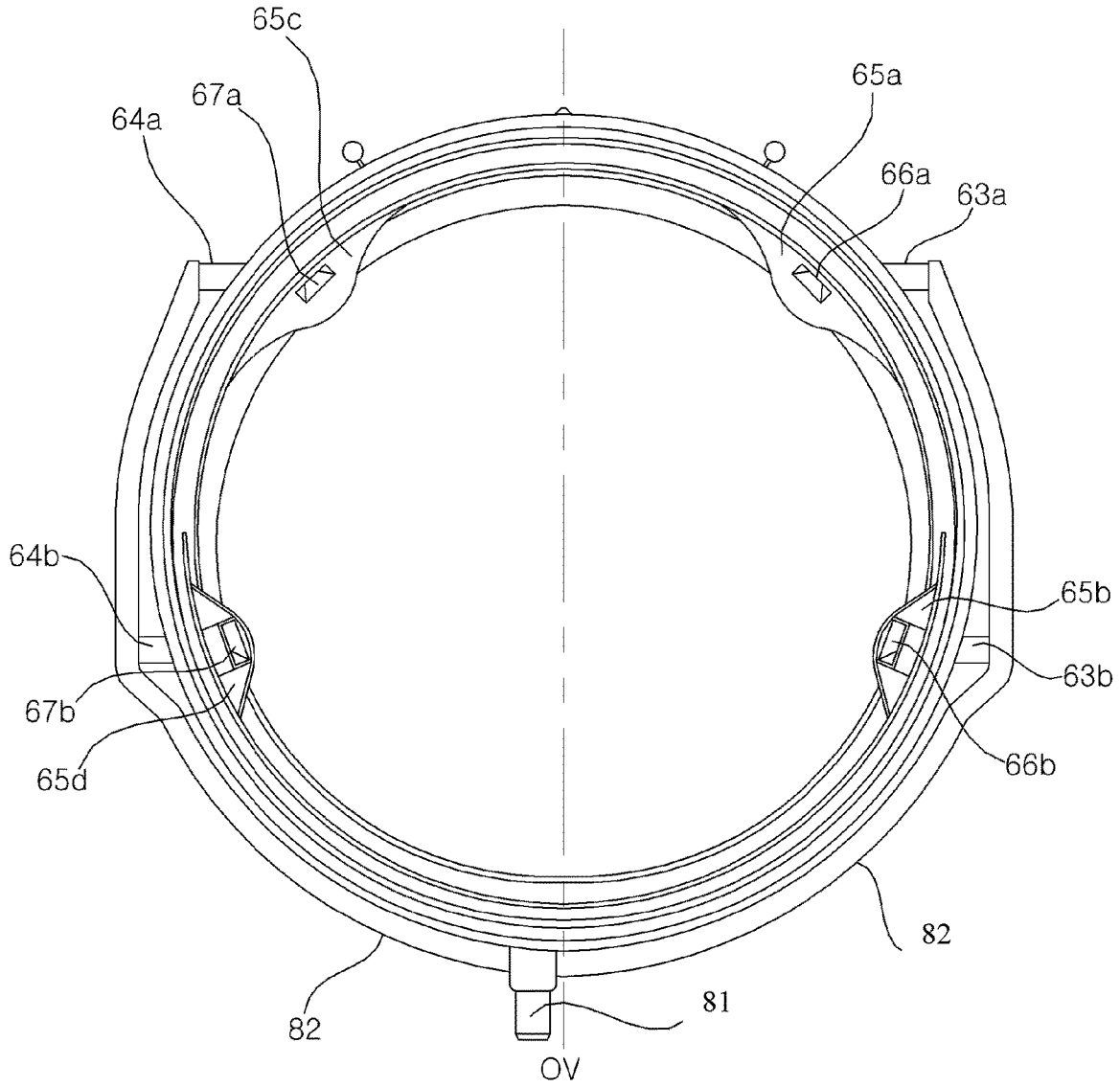
FIG. 6 is a rear view of an assembly including the gasket and a circulating water supply pipe illustrated in FIG. 4.

Referring to FIGS. 3, 4 and 6, the washing machine according to the embodiment of the present disclosure includes a gasket 60 which connects the casing 10 and the tub 30 to each other, nozzles 66 and 67 which injects water into the drum 40, the pump 70 which pressure-feeds the water discharged from the tub 30, a balancer 90 which is disposed on a front surface 31 of the tub 30, and the circulating water supply pipe 80 which guides the water pressure-fed by the pump 70 to the nozzles 66 and 67. In addition, the washing machine may include the connection pipe 86 which guides the water pressure-fed from the pump 70 to the circulating water supply pipe 80.

The plurality of nozzles 66 and 67 may be provided on an inner peripheral surface 62 of the gasket 60 described later. The nozzles 66 and 60 include first and second nozzles 66 and 67 which are respectively disposed on both left and right sides of the inner peripheral surface 62 of the gasket 60. The first nozzle 66 is disposed on the left side of the inner peripheral surface 62 of the gasket 60 and the second nozzle 67 is disposed on the right side of the inner peripheral surface 62 of the gasket 60.

A plurality of first nozzles 66 and a plurality of second nozzles 67 may be respectively provided. In the embodiment of the present embodiment, two first nozzles 66 and two second nozzles 67 are provided. However, the present disclosure is not necessarily limited thereto.

The first nozzle 66 may include a first lower nozzle 66*b* which is disposed below a center of the gasket 60 and a first upper nozzle 66*a* which is disposed above the first lower nozzle 66*b*. The first upper nozzle 66*a* may be disposed above the center of the gasket 60.

The second nozzle 67 may include a second lower nozzle 67*b* which is disposed below the center of the gasket 60 and a second upper nozzle 67*a* which is disposed above the second lower nozzle 67*b*. The second upper nozzle 67*a* may be disposed above the center of the gasket 60.

The first and second lower nozzles 66*b* and 67*b* inject circulating water into the drum 40 and may inject upward. The first and second upper nozzles 66*a* and 67*a* inject the circulating water into the drum 40 and may inject downward. The circulating water means water which is discharged from the tub 30 so as to be pressure-fed by the pump 70, guided by the circulating water supply pipe 80, and injected into the drum 40 through the nozzles 66 and 67.

The gasket 60 may include a direct water nozzle which directly injects the water into the drum 40 and the direct water supply pipe 18 which guides the water supplied through the water supply unit to the direct water nozzle. The direct water nozzle may be a vortex nozzle or a spray nozzle but is not necessarily limited thereto. When viewed from the front side, the direct water nozzle may be disposed on a vertical line OV. A window 20 further protrudes toward the drum 40 than the direct water nozzle, a water stream can come into contact with the window 22, and thus, in this case, the window 22 can be washed.

Figure 5:
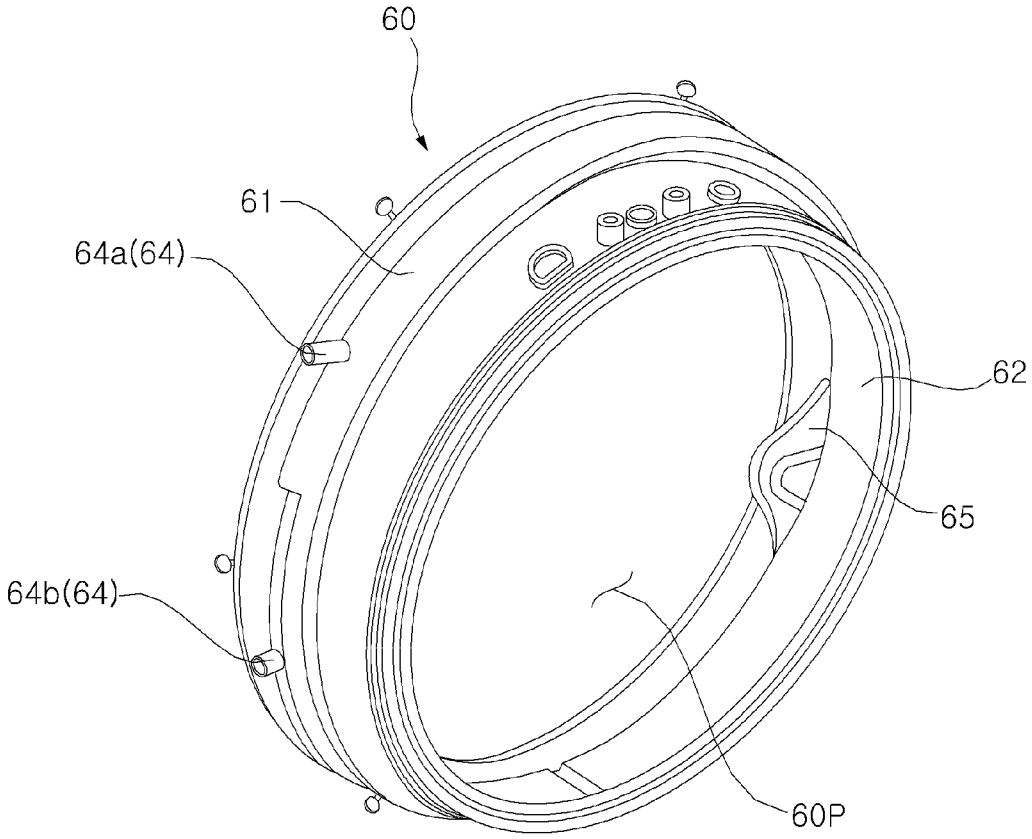
FIG. 5 is a perspective view of a gasket illustrated in FIG. 4.

Referring to FIGS. 3 to 5, the gasket 60 includes a passage 60P which connects the laundry inlet 12 of the casing 10 and the opening 32 of the tub 30 to each other. An inner peripheral surface facing a center direction of the gasket 60 may be referred to as the inner peripheral surface 62, and an outer peripheral surface opposite to the inner peripheral surface may be referred to as an outer peripheral surface 61.

The inner peripheral surface 62 of the gasket 60 forms the passage 60P which connects the laundry inlet 12 and the opening 32 to each other. The outer peripheral surface 61 of the gasket 60 may face an inner peripheral surface 90*a* of the balancer 90. The outer peripheral surface 61 of the gasket 60 may face the circulating water supply pipe 80.

The gasket 60 is disposed between an inlet rim of the front panel 11 forming the laundry inlet 12 and a rim of the tub 30 forming the opening 32, and prevents the washing water stored in the tub 30 from leaking from the tub 30.

In more detail, the gasket 60 is formed of a flexible material such as rubber and has an approximately cylindrical shape (hereinafter, also referred to as a tubular shape). A front edge of the gasket 60 is connected to the inlet rim of the front panel 11, a rear edge of the gasket is connected to the opening rim of the tub 30, and the body portions 61 and 62 connecting the front and rear edges of the gasket 60 to each other form a laundry inlet passage. When a portion between the tub and the front panel is sealed and the door 20 is closed, the door 20 and a distal end of the gasket 60 come into close contact with each other, a portion between the door 20 and the gasket 60 is sealed, and thus, the leakage of the washing water is prevented.

Each of a front end and a rear end of the gasket 60 is formed in an annular shape, and the gasket 60 has a tubular shape extending from the front end to the rear end. The front end of the gasket 60 is fixed to the casing 10 and the rear end thereof is fixed to an inlet periphery 33 of the tub 30. The gasket 60 may be formed of a flexible or elastic material. The gasket 60 may be formed of natural rubber or a synthetic resin.

Hereinafter, a portion defining a tubular inner side of the gasket 60 may be referred to as an inner peripheral portion 62 (or inner peripheral surface) of the gasket and a portion opposite to the inner peripheral portion 62 may be referred to as an outer peripheral portion 61 (or outer peripheral surface).

The gasket 60 may include a casing coupling portion (not illustrated) which is coupled to the periphery of the inlet 12 of the casing 10, a tub coupling portion 68 which is coupled to the inlet periphery 33 of the tub 30, and the body portions 61 and 62 which extend between the casing coupling portion and the tub coupling portion 68.

Each of the casing coupling portion and the tub coupling portion 68 is formed in an annular shape, and the body portion may include an annular front end connected to the casing coupling portion and an annular rear end connected to the tub coupling portion 68 and may have a tubular shape extending from the front end to the rear end.

In the front 11, the periphery of the inlet 12 is curled inward, and the casing coupling portion can be fitted into a concave portion formed by the curled portion.

The casing coupling portion may include an annular groove around which a wire is wound. After the wire is wound around the groove, both ends of the wire are connected to each other, and thus, the casing coupling portion is firmly fixed to the periphery of the inlet 12 of the tub 30.

In the tub 30, the inlet periphery 33 forming the opening 32 of the tub 30 protrudes from a front surface 31 and is curled outward, and the tub coupling portion 68 is fitted into a concave portion formed by the curled portion. The tub coupling portion 68 may include an annular groove around which a clamp 36 formed of a wire is wound. After the tub coupling portion 68 of the gasket is coupled to the inlet periphery 33 of the tub and the clamp 36 is wound along the groove, both ends of the clamp 36 are coupled to each other, and thus, the tub coupling portion 68 is firmly fixed to the inlet periphery 33 of the tub 30.

Meanwhile, the casing coupling portion is fixed to the front panel 11 but the tub coupling portion 68 is displaced according to a movement of the tub 30. Accordingly, the body portion should be deformed according to the displacement of the tub coupling portion 68. In order to smoothly realize the displacement, the gasket 60 may include a folding portion, which is folded when being moved in a direction (or, a radial direction) in which the tub 30 is moved by eccentricity, between a section (or body portion) between the casing coupling portion and the tub coupling portion 68.

The gasket 60 may include connectors 63 and 64 having holes communicating with the nozzles 66 and 67. The connectors 63 and 64 may be formed to protrude from the outer peripheral surface 61 of the gasket 60. Discharge ports 83 and 84 described later are inserted into the connectors 63 and 64, the connectors 63 and 64 are formed to protrude from the outer peripheral surface 61 of the gasket 60, and thus, the water supplied from the circulating water supply pipe 80 to the nozzles 66 and 67 is prevented from leaking between the connectors 63 and 64 and the discharge ports 83 and 84.

As in the above-described nozzles 66 and 67, a plurality of connectors 63 and 64 may be provided, and the number of the connectors 63 and 64 may be the same as that of the nozzles 66 and 67. The connectors 63 and 64 include the first connector 63 which has the hole communicating with the first nozzle 66 and the second connector 64 which has the hole communicating with the second nozzle 67. The first connector may be disposed on a left side of the gasket outer peripheral surface 61 and the second connector 64 may be disposed on a right side of the gasket outer peripheral surface 61.

The first connector 63 may include a first lower connector 63*b* which is disposed below the center of the gasket 60 and a first upper connector 63*a* which is disposed above the first lower connector 63*b*. The first upper connector 63*a* may be disposed above the center of the gasket 60. The first lower connector 63*b* has a hole communicating with the first lower nozzle 66*b* and the first upper connector 63*a* has a hole communicating with the first upper connector 63*a*.

The second connector 64 may include a second lower connector 64*b* which is disposed below the center of the gasket 60 and a second upper connector 64*a* which is disposed above the second lower connector 64*b*. The second upper connector 64*a* may be disposed above the center of the gasket 60. The second lower connector 64*b* has a hole communicating with the second lower nozzle 67*b* and the second upper connector 64*a* has a hole communicating with the second upper connector 64*a*.

Meanwhile, a protrusion 65 may protrude inward from the inner peripheral surface 62 of the gasket at a portion corresponding to the connectors 63 and 64, and the nozzle 66 may be formed at the protrusion 65.

The protrusion 65 may include first to fourth protrusions 65*a*, 65*b*, 65*c*, and 65*d* which protrude inward at portions corresponding to the first upper and lower connectors 63*a* and 63*b* and the second upper and lower connectors 64*a* and 64*b*. The first upper and lower nozzles 66*a* and 66*b* and the second upper and lower nozzles 67*a* and 67*b* may be formed in the first to fourth protrusions 65*a*, 65*b*, 65*c*, and 65*d*.

Figure 7:
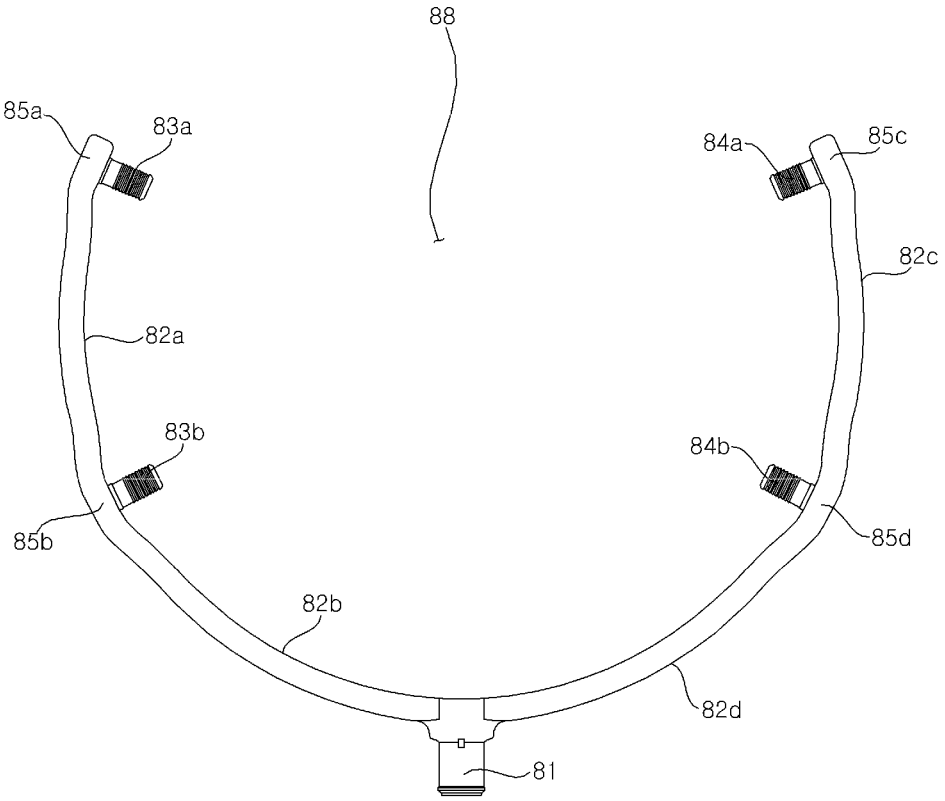
FIG. 7 is a front view of the circulating water supply pipe illustrated in FIG. 4.
Figure 8:
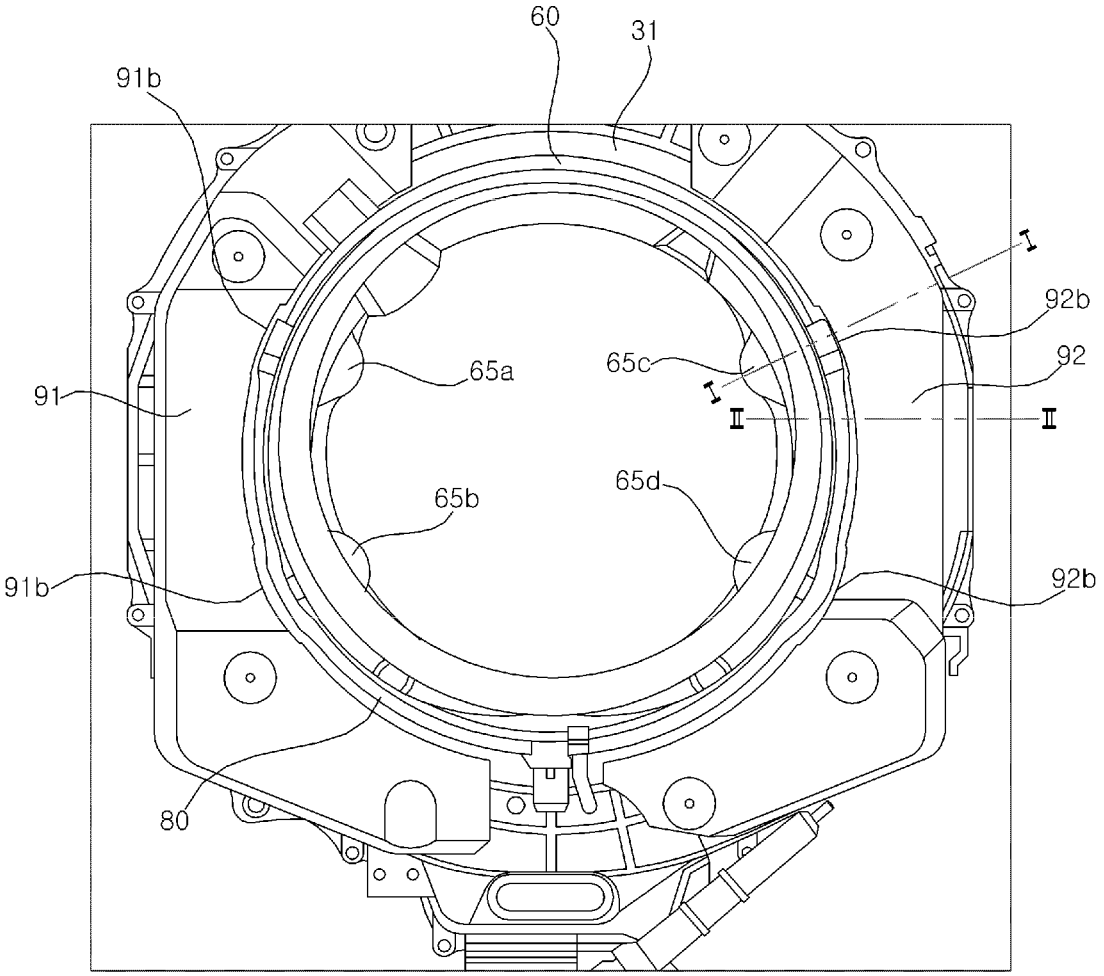
FIG. 8 is a front view illustrating an assembly of a tub, the gasket, a circulating water supply pipe, and a balancer.

Referring to FIGS. 4, 7, and 8, the circulating water supply pipe 80 includes an inlet port 81 into which the water discharged from the pump 70 flows, a feeding conduit 82 which guides the water introduced through the inlet port 81 to the connectors 63 and 64, and the discharge ports 83 and 84 which protrude from the feeding conduit 82 toward a center of the gasket 60 and are inserted into the connectors 63 and 64.

The circulating water supply pipe 80 may be disposed on the outer peripheral surface 61 of the gasket 60. The circulating water supply pip 80 is disposed between the outer peripheral surface 61 of the gasket 60 and the balancer 90. Accordingly, the circulating water supply pipe 80 can be installed without having to secure a separate space.

The circulating water supply pipe 80 may be formed in a ring shape of which an upper portion 88 is open. That is, the circulating water supply pipe 80 includes the inlet portion 81 into which the water pumped from the pump 70 flows, one or more discharge ports 83 and 84 which discharge the introduced water so that the water is injected into the drum 40, and the feeding conduit 82 which connects the inlet port 81 and the discharge ports 83 and 84 to each other, in which one end of left conduit portions 82*a* and 82*b* of the feeding conduit 82 and one end of right conduit portions 82*c* and 82*d* are connected to each other at a position at which the inlet port 81 is provided, and the other end of the left conduit portions 82*a* and 82*b* and the other end of the right conduit portions 82*c* and 82*d* are separated from each other.

The inlet port 81 may be formed to protrude downward at a lower portion of the feeding portion 82, and the discharge ports 83 and 84 may be formed to protrude inward (or toward the gasket side) on left and right sides of the circulating water supply pipe 80. The connection pipe 86 may be disposed between the inlet port 81 and a drain port 78 formed in the pump 70, and thus, the washing water in the tub can flow into the inlet port 81 through the connection pipe 86.

The inlet port 81 is connected to the feeding conduit 82 below any one of the plurality of discharge ports 83 and 84.

The feeding conduit 82 divides the circulating water introduced from the inlet port 81 into a first partial stream and a second partial stream. The first partial stream may be injected into the drum 40 through the first nozzle 66 and the second partial stream may be injected into the drum 40 through the second nozzle 67.

The feeding conduit 82 is disposed between the gasket 60 and the balancer 90. An inner surface of the feeding conduit 82 is disposed to face the gasket 60 and an outer surface thereof is disposed to face to the balancer 90. The feeding conduit 82 is disposed between the outer peripheral surface 61 of the gasket and inner peripheral surfaces 91*a* and 92*a* of the balancer 90. The inner surface of the feeding conduit 82 is disposed to face the outer peripheral surface 61 of the gasket and the outer surface thereof is disposed to face the inner peripheral surfaces 91*a* and 92*a* of the balancer 90. Accordingly, an outer surface 85*e* of first discharge portions 85*a* and 85*b* described later faces a first balancer 91 (the inner peripheral surface 91*a* of the first balancer) and the outer surface 85*e* of the second discharge portions 85*c* and 85*d* faces a second balancer 92 (inner peripheral surface 92*a* of the second balancer).

The feeding conduit 82 is disposed between the gasket 60 and the first and second balancers 91 and 92 described later. The feeding conduit 82 includes discharge portion 85 at positions corresponding to the connectors 63 and 64. As described above, the plurality of connectors 63 and 64 and the plurality of nozzles 66 and 67 are provided, and the plurality of discharge portions 85 is provided. The feeding conduit 82 includes the conduit portions 82*a* to 82*d* connecting the plurality of discharge portions 85 to each other.

The feeding conduit 82 includes the first discharge portions 85*a* and 85*b* at a position corresponding to the first connector 63 and includes the second discharge portions 85*c* and 85*d* at a position corresponding to the second connector 64. Accordingly, the first discharge portions 85*a* and 85*b* are disposed on a left side of the feeding conduit 82 and the second discharge portions 85*c* and 85*d* are disposed on a right side of the feeding conduit 82.

The first discharge portions 85*a* and 85*b* includes the first upper discharge portion 85*a* at a position corresponding to the first upper connector 63*a* and a first lower discharge portion 85*b* at a position corresponding to the first lower connector 63*b*. The second discharge portions 85*c* and 85*d* includes the second upper discharge portion 85*c* at a position corresponding to the second upper connector 64*a* and a second lower discharge portion 85*d* at a position corresponding to the second lower connector 64*b*.

The first upper discharge portion 85*a* may form a left end of the feeding conduit 82 and the second upper discharge portion 85*c* may form a right end of the feeding conduit 82.

In the feeding conduit 82, the discharge portions 85*a*, 85*b*, 85*c*, and 85*d* may be formed to be convex in a direction away from the outer peripheral surface 61 of the gasket 60. Accordingly, the feeding conduit 82 may be disposed by a distance closest to the balancer 90 at the discharge portion 85. Alternatively, the discharge portion 85 may come into contact with the balancer 90 and other portions (conduit portions 82*a* to 82*d* described later) of the feeding conduit 82 may be separated from the balancer 90.

The conduit portions 82*a* to 82*d* may include the first conduit portions 82*a* and 82*b* located on the left side of the feeding conduit 82 and the second conduit portions 82*c* and 82*d* located on the right side of the feeding conduit 82. The first conduit portions 82*a* and 82*b* may include the first upper conduit portion 82*a* which is disposed between the first upper discharge portion 85*a* and the first lower discharge portion 85*b*, and a first lower conduit portion 82*b* which is disposed between the first lower discharge portion 85*b* and an inlet port 81. The second conduit portions 82*c* and 82*d* may include the second upper conduit portion 82*c* which is disposed between the second upper discharge portion 85*c* and the second lower discharge portion 85*d* and a second lower conduit portion 82*d* which is disposed between the second lower discharge portion 82*d* and the inlet port 81.

The discharge ports 83 and 84 protrude from the discharge portion 85 of the feeding conduit toward the center of the gasket 60 and are inserted into the connectors 63 and 64. The discharge ports 83 and 84 guide the circulating water flowing along the feeding conduit 82 to the nozzles 66 and 67 so that the circulating water is injected into the drum 40.

A diameter of each of the discharge ports 83 and 84 is formed to be slight larger than a diameter of each of the connectors 63 and 64 so that the discharge ports 83 and 84 can be press-fitted into the connector 63 and 64. When the circulating water flows from the discharge ports 83 and 84 toward the nozzles 66 and 67, a force may act on the discharge portion 85 in the opposite direction to the gasket 60 by a reaction. In order to prevent the circulating water supply pipe 80 from being removed from the gasket 60 by the reaction force, as described above, the connectors 63 and 64 may be formed to protrude outward from the outer peripheral surface 61 of the gasket 60, the diameters of the discharge ports 83 and 84 may be formed to be slightly larger than the diameters of the connectors 63 and 64, and protrusions may be formed along peripheries of outer diameter portions of the discharge ports 83 and 84 to increase a friction force.

Meanwhile, as described later, lengths 83*l* and 84*l* of the discharge ports 83 and 84 may be longer than a distance D1 between the outer surface 85*e* of the discharge portion 85 and the inner peripheral surfaces 91*a* and 92*a* of the balancer 90. Preferably, lengths 83*l* and 84*l* of the discharge ports 83 and 84 may be at least two times the distance D1 between the outer surface 85*e* of the discharge portion 85 and the inner peripheral surfaces 91*a* and 92*a* of the balancer 90. The gasket 60 formed of a flexible material and the circulating water supply pipe 80 provided in the gasket 60 may be vibrated by vibrations of the tub 30, and a relative distance between the gasket 60 and the balancer 90 fixed to the front surface of the tub 30 is changed. Accordingly, preferably, the lengths 83*l* and 84*l* of the discharge ports 83 and 84 are at least two times the distance D1.

The discharge ports 83 and 84 include a first discharge port 83 which protrudes from the first discharge portions 85*a* and 85*b* toward the center of the gasket 60 and a second discharge port 84 which protrudes from the second discharge portions 85*c* and 85*d* toward the center of the gasket 60. The first discharge port 83 is inserted into the first connector 63 to guide the circulating water to the first nozzle 66 and the second discharge port 84 is inserted into the second connector 64 to guide the circulating water to the second nozzle 67.

The first discharge port 83 may include a first lower discharge port 83*b* which is inserted into the first lower connector 63*b* and a first upper discharge port 83*a* which is inserted into the first upper connector 63*a*. The first lower discharge port 83*b* and the first upper discharge port 83*a* respectively protrude from the first lower discharge portion 85*b* and the first upper discharge portion 85*a*, and are respectively inserted into the first upper connector 63*a* and the first lower connector 63*b* to guide the circulating water to the first upper nozzle 66*a* and the first lower nozzle 66*b*.

The second discharge port 84 may include a second lower discharge port 84*b* which is inserted into the second lower connector 64*b* and a second upper discharge port 84*a* which is inserted into the second upper connector 64*a*. The second lower discharge port 84*b* and the second upper discharge port 84*a* respectively protrude from the second lower discharge portion 85*d* and the second upper discharge portion 85*c*, and are respectively inserted into the second upper connector 64*a* and the second lower connector 64*b* to guide the circulating water to the second upper nozzle 67*a* and the second lower nozzle 67*b*.

One end of the connection pipe 86 is connected to the inlet port 81 protruding from a lower portion of the circulating water supply pipe 80 and the other end thereof is connected to the drain port 74 of the pump 70. When the pump 70 is provided at a position which the drain port 78 linearly faces the inlet port 81, the connection pipe 86 may have a linear pipe shape. However, in other cases, the connection pipe 86 may be formed to be bent.

When the connection pipe 86 is formed to be bent, the connection pipe 86 may include a first connection portion of which one end is connected to the inlet port 81 of the circulating water supply pipe and which is formed to extend downward, a second connection portion which is bent rearward from the first connection portion and is located below the tub 30, a third connection portion which is bent from the second connection portion to the pump side, and a fourth connection portion which is bent downward from the third connection portion and is connected to the pump 70.

The first to fourth connection portions may be respectively formed to be coupled to each other or may be formed integrally. The connection pipe 86 may be formed of a material which is flexible but can maintain a shape, and may be formed of ethylene propylene diene monomer rubber (EPDM) in an embodiment of present disclosure. The fourth connection portion may include a bellows structure.

Referring to FIGS. 3 and 7, the balancer 90 may be fastened to the front surface 31 of the tub 30. The balancer 90 is disposed outside the front surface 31 of the tub 30 and the gasket 60. The balancer 90 is provided to reduce vibrations of the tub 30 and is a weight body having a predetermined weight.

Figure 9:
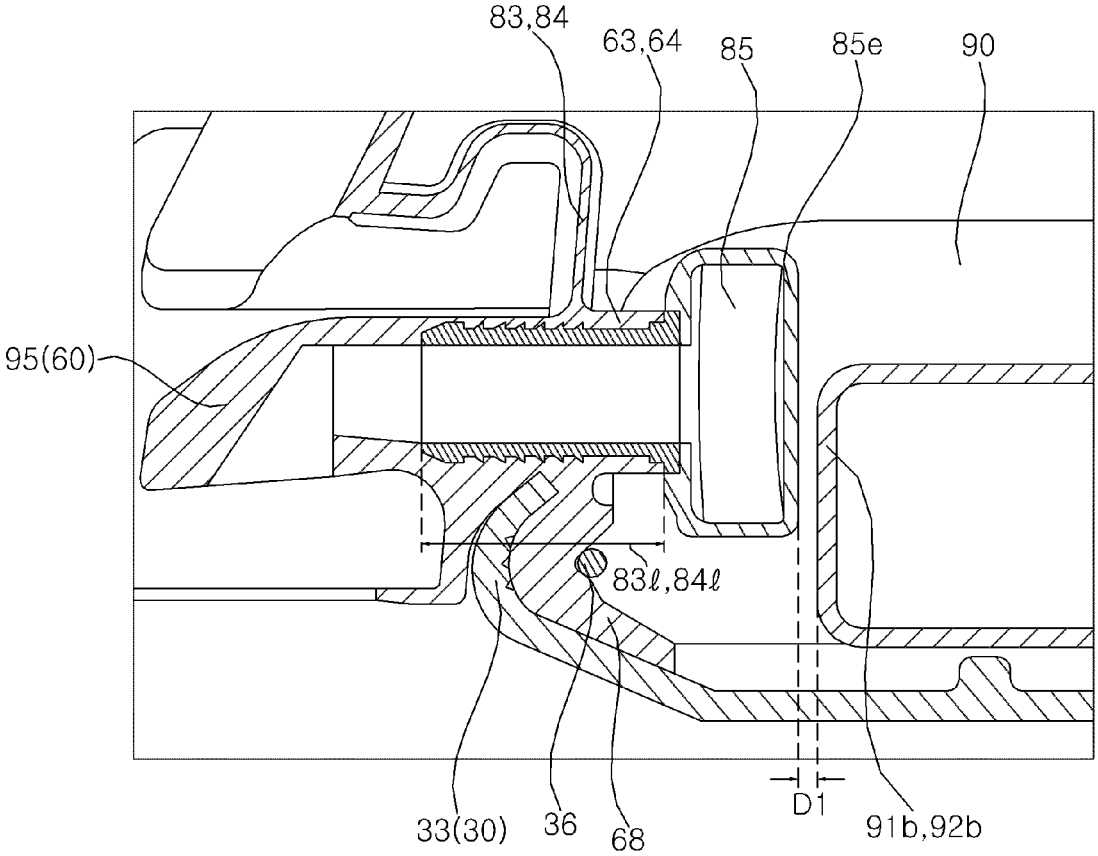
FIG. 9 is a cross-sectional view taken along line I-I illustrated in FIG. 8.

Referring to FIGS. 8 and 9, the balancer 90 may be in contact with the outer surface 85*e* of the discharge portion 85 of the feeding conduit 82 or may be disposed to be spaced apart by the predetermined distance D1. The predetermined distance D1 is a distance for preventing the circulating water supply pipe 80 from being removed from the gasket, and the distance D1 is shorter than the lengths 83*l* and 84*l* of the discharge ports 83 and 84. That is, the balancer 90 is disposed to be spaced apart from the outer surface 85*e* of the discharge portion 85 at an interval shorter than the lengths 83*l* and 84*l* of the discharge port. In addition, as described above, the lengths 83*l* and 84*l* of the discharge ports 83 and 84 may be formed to be at least two times the distance D1 between the outer surface 85*e* of the discharge portion 85 and the balancer 90.

Accordingly, even when the discharge ports 83 and 84 are moved in a transverse direction by a water flow pressure when the circulating water is discharged from the discharge ports 83 and 84 or the vibrations of the tub 30, the discharge portion 85 can come into ease contact with (or can easily interfere with) the balancer 90. Accordingly, the movements of the discharge ports 83 and 84 are prevented, the discharge ports 83 and 84 interfere with the balancer 90 before the discharge ports 83 and 84 moves in a direction separated from the connectors 63 and 64 by the lengths 83*l* and 84*l* of the discharge ports 83 and 84, and thus, the discharge ports 83 and 84 can be prevented from being separated from the connectors 63 and 64.

The balancer 90 includes a first balancer 91 which is disposed on the left side of the gasket 60 and a second balancer 92 which is disposed on the right side of the gasket 60. The first balancer 91 and the second balancer 92 may be separated from each other on upper and lower sides thereof. The first and second balancers 91 and 92 may be right and left symmetrical with respect to the vertical line OV passing through the center of the gasket 60, and may be disposed at positions which are right and left symmetrical with respect to the vertical line OV.

The first balancer 91 is disposed to be separated from the outer surface 85*e* of the first discharge portions 85*a* and 85*b* facing the first balancer 91 by the distance D1 which is shorter than the length 83*l* of the first discharge port 83, and the second balancer 92 is disposed to be separated from the outer surface 85*e* of the second discharge portions 85*c* and 85*d* facing the second balancer 92 by the distance D1 which is shorter than the length 84*l* of the second discharge port 84.

Figure 10:
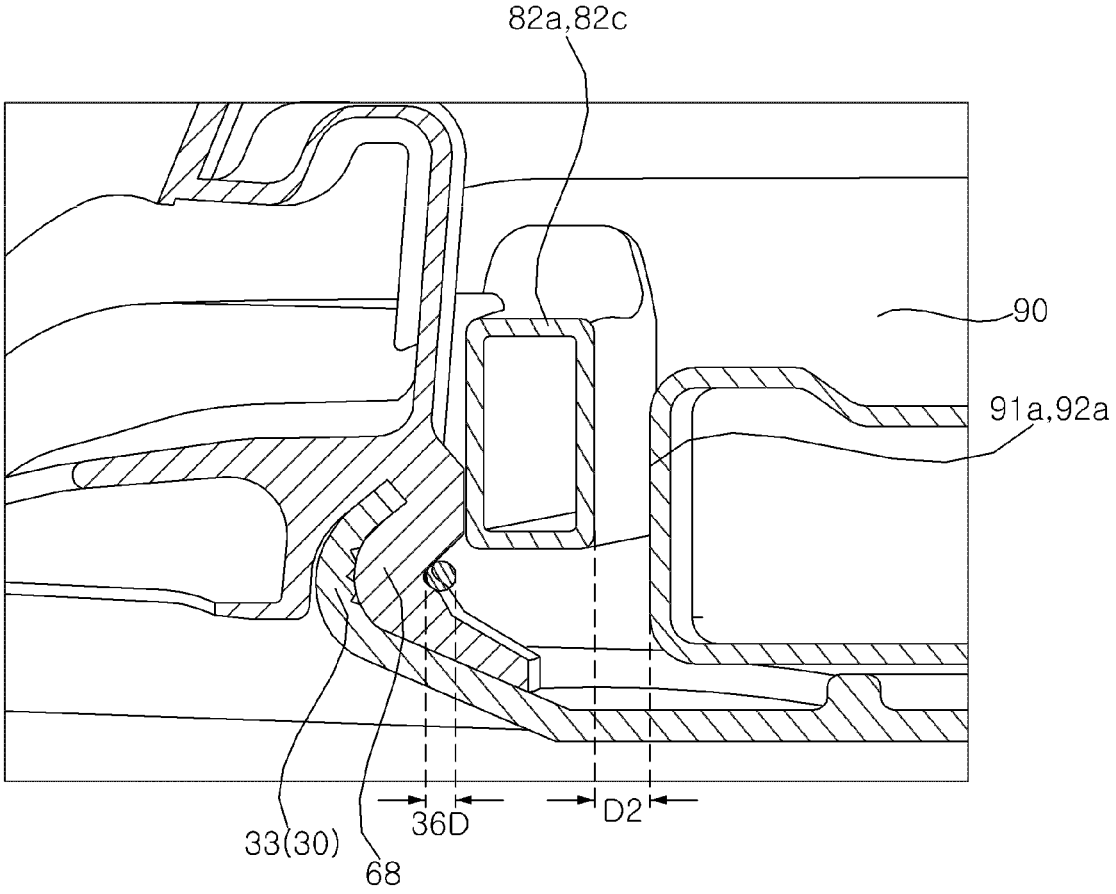
FIG. 10 is a cross-sectional view taken along line II-II illustrated in FIG. 8.

Referring to FIGS. 8 and 10, the inner peripheral surfaces 91*a* and 92*a* of the first and second balancers 91 and 92 are disposed to face the outer peripheral surface 61 of the gasket 60 and each of the inner peripheral surfaces 91*a* and 92*a* is formed in an arc shape corresponding to the outer peripheral surface 61 of the gasket 60.

The inner peripheral surfaces 91*a* and 92*a* of the first and second balancers 91 and 92 may include support portions 91*b* and 92*b* at a position corresponding to the discharge portion 85 of the circulating water supply pipe 80. When the above-described circulating water supply pipe 80 is separated from the gasket 60, the support portions 91*b* and 92*b* may be portions for supporting the circulating water supply pipe 80 such that the circulating water supply pipe 80 is not removed.

The support portions 91*b* and 92*b* may be formed to be concave in a direction away from the outer peripheral surface 61 of the gasket 60. However, the support portions 91*b* and 92*b* may be formed to be concave to have a difference smaller than a radial difference between the conduit portions 82*a* to 82*d* and the discharge portion 85. Accordingly, even when the support portions 91*b* and 92*b* are formed to be concave, as described above, the circulating water supply pipe 80 is disposed to be closest to the balancer 90 at the discharge portion 85 formed to be convex, and a distance D2 between the conduit portions 82*a* to 82*d* and the balancer 90 may be smaller than the distance D1 between the discharge portion 85 and the balancer 90.

The first and second balancers 91 and 92 may be disposed such that the distance D2 between the conduit portions 82*a* to 82*d* of the circulating water supply pipe 80 and the first and second balancers 91 and 92 is larger than a diameter 36D of the clamp 36. Accordingly, when the gasket 60 is separated from the tub 30 in service of the gasket 60 or the circulating water supply pipe 80, the clamp 36 can be easily removed between the conduit portions 82*a* to 82*d* and the balancer 90. Therefore, during the service, the gasket 60 and the circulating water supply pipe can be serviced in a state where the balancer 90 is coupled to the tub 30 without separating and leaving the larger and heavy balancer in a residence of a user where the washing machine is installed.

The support portions 91*b* and 92*b* may be formed to be concave in the direction away from the outer peripheral surface 61 of the gasket 60. Accordingly, during the above-described service, the clamp 36 can be removed between the discharge portion 85 and the balancer 90.

However, unlike the distance D2 between the conduit portions 82*a* to 82*d* and the balancer 90, the distance D1 between the outer peripheral surface 85*e* of the first and second discharge portions 85*a*, 85*b*, 85*c*, and 85*d* and the second balancers 91 and 82 may be smaller than or equal to the diameter 36D of the clamp 36. In the outer surface of the circulating water supply pipe 80, a ratio occupied by the conduit portions 82*a* to 82*d* is larger than a ratio occupied by the discharge portion 85, and the gasket 60 is formed of a flexible material. Accordingly, even when the clamp 36 is caught between the discharge portion 85 and the balancer 90, the clamp 36 can be easily removed by moving the gasket 60, and if the clamp is removed between the discharge portion 85 and the balancer 90, the clamp 36 can be separated from the washing machine and the gasket 36 may be separated from the tub.

Hereinbefore, preferred embodiments of present disclosure are illustrated and described. However, present disclosure is not limited to the specific embodiments described above, the present disclosure may be variously modified by those skilled in the art without departing from a scope of the present disclosure claimed in the claims, and the modifications should not be understood individually from a technical spirit or outlook of the present disclosure.

According to the washing machine of the present disclosure, the following one or more effects are exerted.

First, the feeding conduit which guides the water flowing into the circulating water supply pipe to the first and second connectors of the gasket is disposed between the first and second balancers and the gasket, and thus, the circulating water supply pipe is prevented from being removed from the gasket.

Second, the first and second balancers are disposed to be spaced from the outer surfaces of the first and second discharge portions by the distance shorter than the lengths of the first and second discharge ports inserted into the first and second connectors, and thus, it is possible to prevent the circulating water supply pipe from being removed without fastening the gasket and the circulating water supply pipe by the clamp.

Third, the tub and the gasket are fixed to each other by the clamp formed of a wire, the distance between the conduit portion of the feeding conduit and the first and second balancers is larger than the diameter of the clamp, and thus, the gasket and the tub can be assembled or disassembled to each other without separating the balancers from the tub. Accordingly, particularly, when the circulating water supply pipe and/or the gasket are serviced, the gasket can be separated from the tub in a state where the balancer is coupled to the tub without separating the larger and heavy balancer, and thereafter, separating the gasket from the tub in a residence of a user.

Effects of the present disclosure are not limited to the above-described effects, and other effects not mentioned are clearly understood by a person skilled in the art.

What is claimed is:

1. A washing machine comprising:

a casing that defines a laundry inlet at a front surface;

a tub that is disposed in the casing and that defines a tub opening at a front surface of the tub;

a drum rotatably disposed in the tub;

a gasket that defines a passage that connects the laundry inlet to the tub opening;

a first nozzle disposed at an inner peripheral surface of the gasket and configured to supply water into the drum, the first nozzle being disposed at a right side of the gasket with respect of a center of the gasket;

a second nozzle disposed at the inner peripheral surface of the gasket and configured to supply water into the drum, the second nozzle being disposed at a left side of the gasket with respect of the center of the gasket;

a pump configured to pump water discharged from the tub;

a first balancer that is disposed on the front surface of the tub and that is disposed outside the gasket, the first balancer being disposed at the right side of the gasket;

a second balancer that is disposed on the front surface of the tub and that is disposed outside the gasket, the second balancer being disposed at the left side of the gasket; and a circulating water supply pipe configured to guide water discharged from the pump to the first nozzle and the second nozzle, wherein the gasket comprises a first connector that defines a first hole in communication with the first nozzle and a second connector that defines a second hole in communication with the second nozzle, wherein the circulating water supply pipe comprises:

an inlet port configured to receive the water discharged from the pump, a feeding conduit that is disposed at a position between a front portion of the gasket and each of the first balancer and the second balancer, that is configured to guide the water received through the inlet port to the first nozzle and the second nozzle, and that comprises a first discharge portion facing the first connector and a second discharge portion facing the second connector, a first discharge port that protrudes from the first discharge portion toward the center of the gasket and that is inserted to the first connector, and a second discharge port that protrudes from the second discharge portion toward the center of the gasket and that is inserted into the second connector, wherein the first balancer is spaced apart from an outer surface of the first discharge portion facing the first balancer by a first distance that is less than a first length of the first discharge port, and wherein the second balancer is spaced apart from an outer surface of the second discharge portion facing the second balancer by a second distance that is less than a second length of the second discharge port.

2. The washing machine of claim 1, wherein the first connector and the second connector protrude from an outer peripheral surface of the gasket opposite to the inner peripheral surface of the gasket.

3. The washing machine of claim 1, wherein the first length of the first discharge port is at least two times of the first distance between the outer surface of the first discharge portion and the first balancer, and wherein the second length of the second discharge port is at least two times of the second distance between the outer surface of the second discharge portion and the second balancer.

4. The washing machine of claim 1, wherein the feeding conduit is convex in a direction away from an outer peripheral surface of the gasket opposite to the inner peripheral surface of the gasket.

5. The washing machine of claim 4, wherein each of the first balancer and the second balancer comprises an arc-shaped inner peripheral surface facing the outer peripheral surface of the gasket.

6. The washing machine of claim 5, wherein the arc-shaped inner peripheral surface of the first balancer comprises a first support portion that is concave and faces the outer surface of the first discharge portion, and wherein the arc-shaped inner peripheral surface of the second balancer comprises a second support portion that is concave and faces the outer surface of the second discharge portion.

7. The washing machine of claim 4, wherein the tub comprises an inlet periphery that defines the tub opening and that protrudes from the front surface of the tub and is curved radially outward, wherein the gasket comprises a tub coupling portion that is coupled to the inlet periphery of the tub, and wherein the washing machine further comprises a clamp that is located at the tub coupling portion and that fixes the gasket to the tub.

8. The washing machine of claim 7, wherein the clamp comprises a wire.

9. The washing machine of claim 8, wherein the feeding conduit comprises a conduit portion that extends from the first discharge portion to the second discharge portion, and wherein a distance from the conduit portion to each of the first balancer and the second balancer is greater than a diameter of the wire.

10. The washing machine of claim 8, wherein a distance from the outer surface of the first discharge portion to the first balancer is less than or equal to a diameter of the wire, and wherein a distance from the outer surface of the second discharge portion to the second balancer is less than or equal to the diameter of the wire.

11. The washing machine of claim 8, wherein the first nozzle comprises a first plurality of nozzles arranged on the right side of the gasket, and the second nozzle comprises a second plurality of nozzles arranged on the left side of the gasket.

12. The washing machine of claim 11, wherein the first plurality of nozzles comprise:

a first lower nozzle disposed vertically below the center of the gasket; and a first upper nozzle disposed vertically above the first lower nozzle, and wherein the second plurality of nozzles comprise:

a second lower nozzle disposed vertically below the center of the gasket; and a second upper nozzle disposed vertically above the second lower nozzle.

13. The washing machine of claim 12, wherein the first connector comprises:

a first lower connector that defines a first lower hole in communication with the first lower nozzle; and a first upper connector that defines a first upper hole in communication with the first upper nozzle, and wherein the second connector comprises:

a second lower connector that defines a second lower hole in communication with the second lower nozzle, and a second upper connector that defines a second upper hole in communication with the second upper nozzle.

14. The washing machine of claim 13, wherein the first discharge port comprises:

a first lower discharge port inserted into the first lower connector and a first upper discharge port inserted into the first upper connector, and wherein the second discharge port comprises a second lower discharge port inserted into the second lower connector and a second upper discharge port inserted into the second upper connector.

15. The washing machine of claim 14, wherein the inlet port is disposed between the first lower discharge port and the second lower discharge port.

16. The washing machine of claim 12, wherein the first lower nozzle is disposed at a position symmetric to a position of the second lower nozzle with respect to a vertical line passing through the center of the gasket, and wherein the first upper nozzle is disposed at a position symmetric to a position of the second upper nozzle with respect to the vertical line passing through the center of the gasket.

17. The washing machine of claim 16, wherein the inlet port is offset from the vertical line passing through the center of the gasket toward the first discharge port or the second discharge port.

18. The washing machine of claim 1, wherein the first balancer and the second balancer are space apart from each other in a left-right direction with respect to the center of the gasket, and wherein a distance between upper portions of the first balancer and the second balancer is greater than a distance between lower portions of the first balancer and the second balancer.

19. The washing machine of claim 1, wherein the gasket further comprises:

a first protrusion that protrudes inward from the inner peripheral surface of the gasket toward the center of the gasket, that is disposed at a position opposite to the first connector, and that defines the first nozzle; and a second protrusion that protrudes inward from the inner peripheral surface of the gasket toward the center of the gasket, that is disposed at a position opposite to the second connector, and that defines the second nozzle.

20. The washing machine of claim 1, wherein the feeding conduit comprises a conduit portion that extends from the first discharge portion to the second discharge portion, and wherein a distance from the conduit portion to each of the first balancer and the second balancer is greater than each of the first distance and the second distance.

* * * * *